US009474401B2

(12) United States Patent
Amos

(10) Patent No.: US 9,474,401 B2
(45) **Date of Patent: *Oct. 25, 2016**

(54) SPRING-LOADED ADJUSTABLE WINDOW RACK

(71) Applicant: Joyce C Amos, Ashland, OH (US)

(72) Inventor: Joyce C Amos, Ashland, OH (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/014,289

(22) Filed: Feb. 3, 2016

(65) Prior Publication Data

US 2016/0150904 A1 Jun. 2, 2016

Related U.S. Application Data

(63) Continuation-in-part of application No. 14/691,425, filed on Apr. 20, 2015, now Pat. No. 9,282,844, which is a continuation-in-part of application No. 14/315,853, filed on Jun. 26, 2014, now Pat. No. 9,049,952.

(60) Provisional application No. 61/841,265, filed on Jun. 28, 2013.

(51) Int. Cl.

| | |
|---|---|
| ***A47H 2/00*** | (2006.01) |
| ***A47H 1/122*** | (2006.01) |
| ***A47H 1/142*** | (2006.01) |
| ***A47H 1/02*** | (2006.01) |
| ***A47H 1/022*** | (2006.01) |

(52) U.S. Cl.

CPC ..... *A47H 1/122* (2013.01); *A47H 1/02* (2013.01); *A47H 1/022* (2013.01); *A47H 1/142* (2013.01); *A47H 2001/0205* (2013.01); *A47H 2001/0215* (2013.01)

(58) Field of Classification Search

CPC ..... A47H 1/122; A47H 1/142; A47H 1/02; A47H 2/00; A47H 2/02; A47H 2001/0205; A47H 2001/0215

USPC ..... 160/38, 39, 21, 22, 56, 57, 64, 83.1, 160/352, 374, 374.1, 376, 84.07, 134

See application file for complete search history.

(56) References Cited

U.S. PATENT DOCUMENTS

| | | | | |
|---|---|---|---|---|
| 1,240,581 | A * | 9/1917 | Kirsch et al. | E06B 9/52 160/374 |
| 5,547,010 | A * | 8/1996 | Stuart | A47H 1/18 160/335 |
| 5,706,878 | A * | 1/1998 | Guettler | A47H 1/02 160/330 |
| 8,215,370 | B2 * | 7/2012 | Erdahl | B60J 1/025 160/372 |
| 9,049,952 | B2 * | 6/2015 | Amos | E06B 9/24 |

* cited by examiner

*Primary Examiner* — Blair M Johnson
(74) *Attorney, Agent, or Firm* — Sinorica, LLC

(57) ABSTRACT

A spring-loaded adjustable window rack for hanging window treatments. A window rack is formed from a plurality of slide members, a plurality of multi-directional connectors, and at least one spring-loaded coupler, wherein the plurality of slide members is attached to each other by the plurality of multi-directional connectors. Each of the at least one spring-loaded couplers is attached in between a specific connector from the plurality of multi-directional connectors and a corresponding slide member from the plurality of slide members. By compressing the at least one spring the window rack can be slid into a window frame, wherein the spring force holds the window rack in place. A window treatment support can be attached to the window rack for creating three dimensional window treatment arrangements.

4 Claims, 9 Drawing Sheets

SPRING-LOADED ADJUSTABLE WINDOW RACK

The current application is a continuation in part of U.S. Utility patent application Ser. No. 14/691,425 filed Apr. 20, 2015 which is a continuation in part of U.S. Utility patent application Ser. No. 14/315,853 filed Jun. 26, 2014 which claims benefit of the U.S. Provisional Patent Application Ser. No. 61/841,265 filed Jun. 28, 2013.

FIELD OF THE INVENTION

The present invention relates generally to window hangings. More specifically, the present invention is a customizable window rack for supporting and displaying window treatments.

BACKGROUND OF THE INVENTION

It is common to install window treatments, such as drapes, valances, curtains, and other various hangings, about windows. Such window treatments can be used either entirely for decorative purposes or be used to block out light as well. Typically, these window treatments are not installed directly onto a window frame, but rather are installed through the use of a rod, brackets, hooks, or similar hanging mechanisms. Many hanging mechanisms require the use of screws or nails in order to be installed into the window frame and thus cause permanent damage to the window frame. The tools needed to install these hanging mechanisms may not be available to or suitable for all individuals. For example, it may be difficult for the elderly to reach up high while maneuvering tools such as a hammer or screw driver.

Additionally, the permanent nature of many hanging mechanisms limits an individual from changing the way in which window treatments are hung as it is often undesirable to install a second hanging fixture, causing more damage to the window frame. Thus an individual is usually limited to single hanging fixture. Hanging mechanisms of this nature are also problematic for individuals living in temporary residencies such as dormitories or apartments. Often time permission is required to install hanging mechanisms in such situations, wherein the individual may be required to pay a fee for damages or be required to refurbish the window frame themselves upon relocation.

Therefore it is the object of the present invention to provide a spring loaded window rack that can readily be installed in a window frame without the use of any permanent fasteners. The present invention provides a window rack being formed from a plurality of slide members and a plurality of multi-directional connectors, wherein the plurality of slide members and the plurality of multi-directional connectors can be arranged in a number of ways to fit any size and shape window. At least one spring-loaded coupler is provided, that allows for the compression of the window rack, such that the window rack can be slid into the desired window frame. The at least one spring-loaded coupler then acts to provide a constant tension force on the window frame to securely hold the window rack in place. A window treatment support can then be attached to the window rack, wherein the window treatment rack provides a means for creating three dimensional window treatment arrangements. The window treatment support can be configured in any number of shapes in order to provide unique window treatment arrangements.

DETAIL DESCRIPTIONS OF THE INVENTION

All illustrations of the drawings are for the purpose of describing selected versions of the present invention and are not intended to limit the scope of the present invention.

The present invention is a spring-loaded adjustable window rack for supporting and displaying window treatments. The present invention can be quickly assembled and installed into a window frame without the use of any tools. Additionally, the present invention can be utilized as either a temporary or permanent fixture. In the preferred embodiment of the present invention, the components are fabricated from polyvinylchloride, however, it is possible for any other material or materials to be used in the construction of the present invention, with preference given to materials with high strength and being light in weight.

Figure 2:
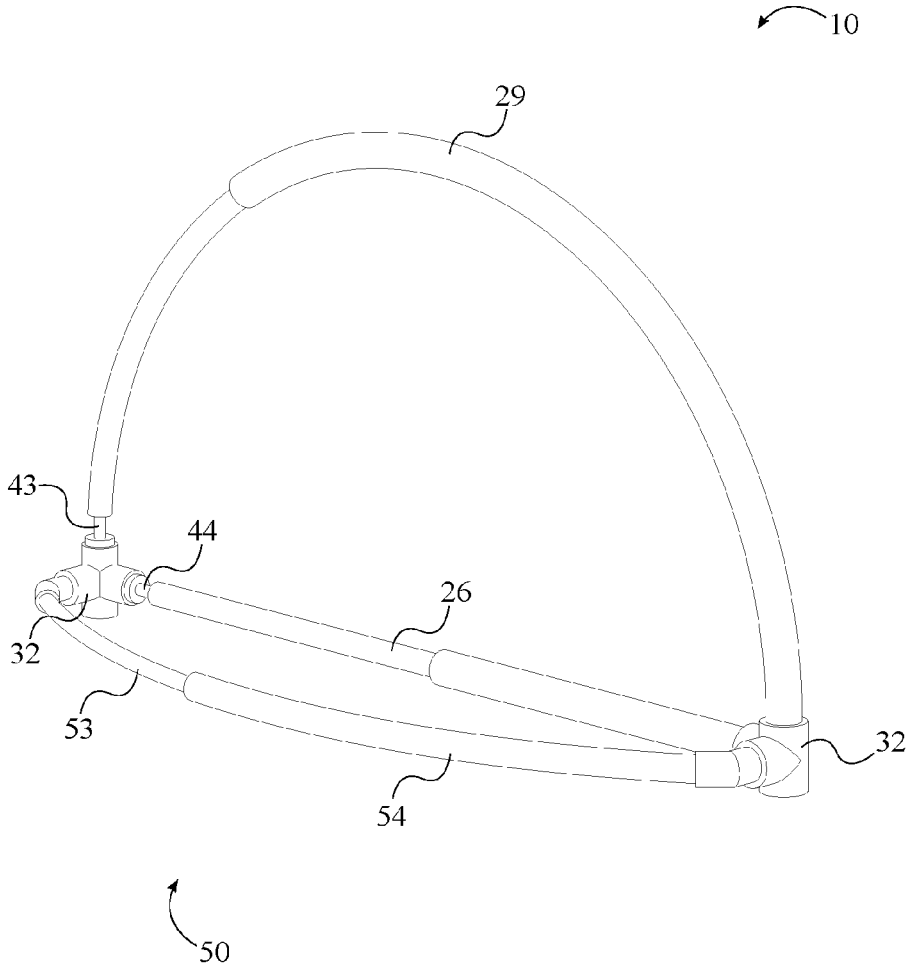
FIG. 2 is a perspective view of the window rack being a semi-circle and having a window treatment support attached.

In reference to FIG. 2, the spring-loaded adjustable window rack comprises a plurality of slide members 20, a plurality of multi-directional connectors 30, an at least one spring-loaded coupler 40, and a window treatment support 50. Together, the plurality of slide members 20, the plurality of multi-directional connectors 30, and the at least one spring-loaded coupler 40 form a window rack 10 that is sized and shaped to snuggly fit within the inner perimeter of a window. The plurality of slide members 20 allows for the length of each side of the window rack 10 to be adjusted in order to fit windows of various sizes, while the plurality of multi-directional connectors 30 allows the window rack 10 to take on multiple shapes. The at least one spring-loaded coupler 40 provides a constant pressure between the window rack 10 and the window frame, such that the window rack 10 is securely held in place within the window frame.

Figure 1:
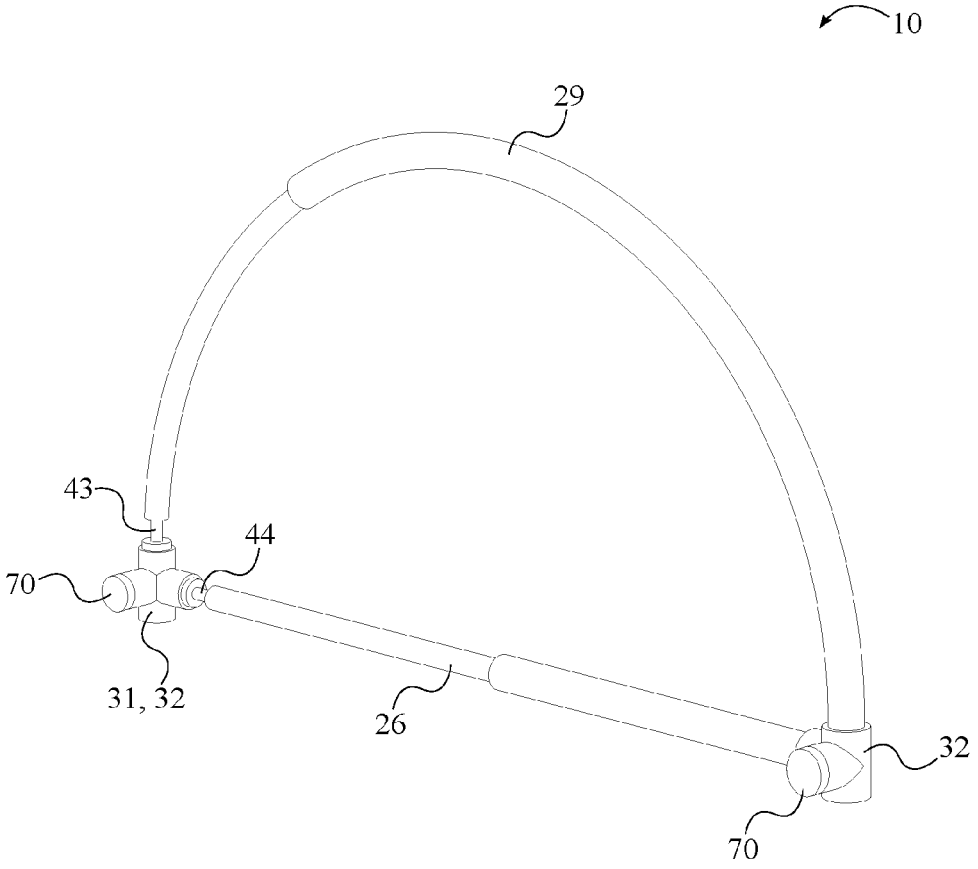
FIG. 1 is a perspective view of the window rack being a semi-circle in the preferred embodiment of the present invention.

In reference to FIG. 1, the plurality of slide members 20 is attached to each other by the plurality of multi-directional connectors 30 in order to form the desired shape. At least one of the plurality of slide members 20 is connected to at least one of the plurality of multi-directional connectors 30 by the at least one spring-loaded coupler 40. Depending on the desired shape of the window rack 10, the at least one spring-loaded coupler 40 may be specifically a single spring-loaded coupler 41, specifically a pair of spring-loaded couplers 42, a first spring-loaded coupler 43 and a second spring-loaded coupler 44, etc. Each of the at least one spring-loaded coupler 40 is attached in between a specific connector 31 from the plurality of multi-directional connectors 30 and a corresponding slide member 25 from the plurality of slide members 20.

Figure 3:
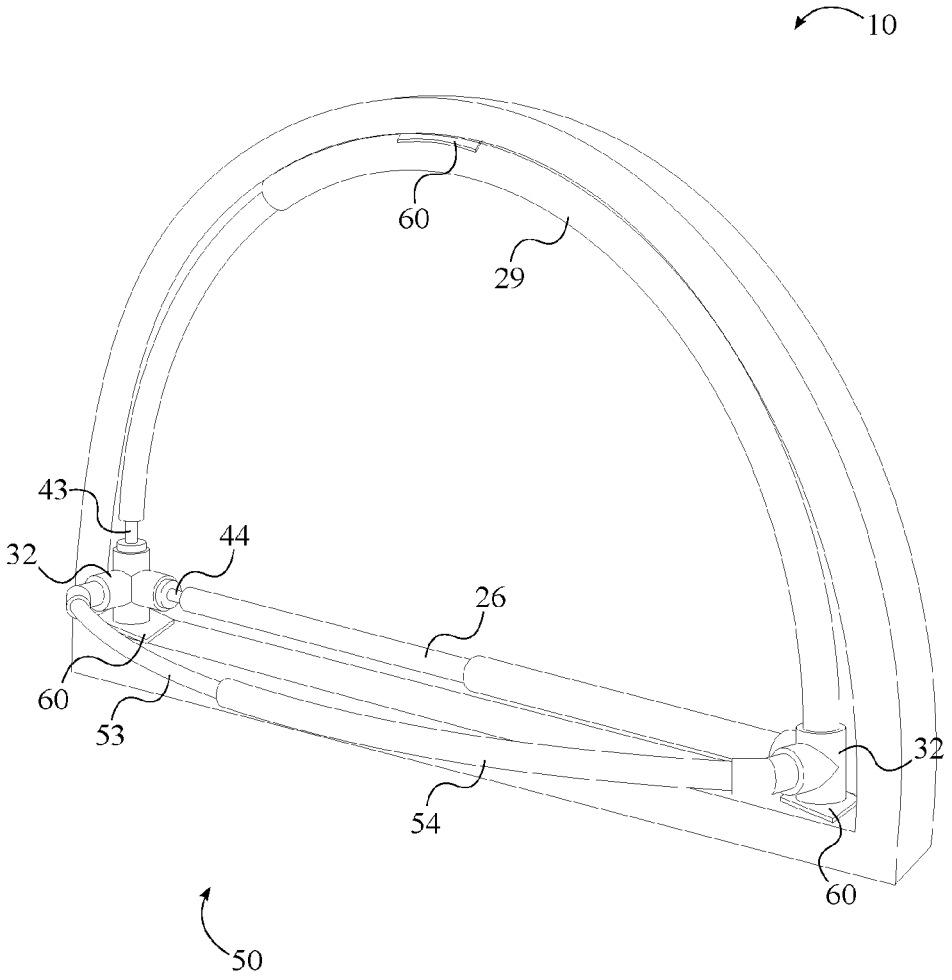
FIG. 3 is a perspective view of the window rack being positioned within a window frame, wherein a plurality of pads is positioned between the window rack and the window frame.

In reference to FIG. 3, a plurality of friction pads 60 may be employed in the present invention. The plurality of friction pads 60 is positioned in between the window rack 10 and the window frame and serves two purposes. The first purpose being to protect the window frame for being scratched, scraped, or otherwise damaged while the window rack 10 is installed. The second purpose being to provide greater friction between the window rack 10 and the window frame, such that the window rack 10 is securely held in place and will no inadvertently slide out of the window frame.

Figure 8:
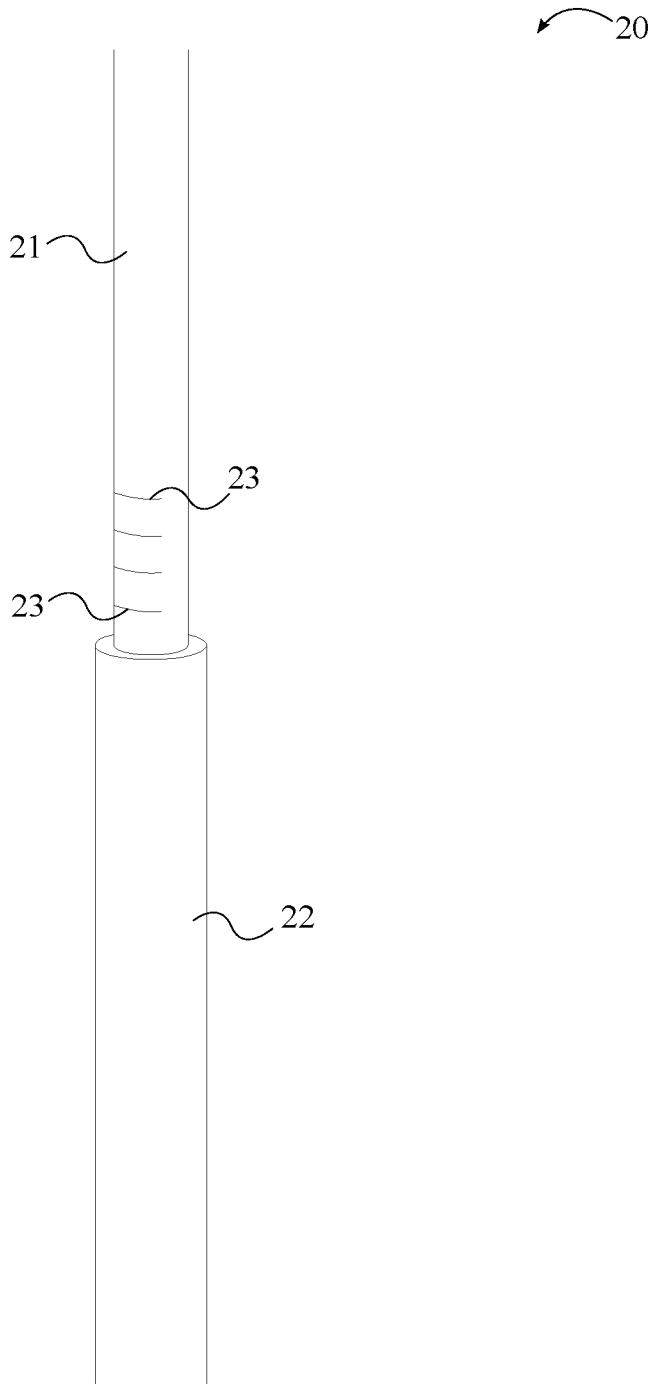
FIG. 8 is perspective view of one of the plurality of slide members showing the plurality of markings along the inner rod.

In reference to FIG. 8, each of the plurality of slide members 20 comprises an inner rod 21, an outer rod 22, and a plurality of markings 23. The inner rod 21 is slidably attached to the outer rod 22 and is positioned into the outer rod 22. In this way, each of the plurality of slide members 20 is adjustable in length by manipulating the depth into which the inner rod 21 is positioned into the outer rod 22. The plurality of markings 23 is used to determine the depth at which the inner rod 21 is positioned into the outer rod 22, thus allowing for the consistent length adjustment of opposing slide members. As such, the plurality of markings 23 is positioned along the inner rod 21, adjacent to the outer rod 22. Each of the plurality of markings 23 may be an arbitrary symbol, such as a line, or a sequential number. Additionally, the plurality of markings 23 may be spaced in accordance with a standard unit of measure, or at arbitrary, yet equal increments.

Figure 9:
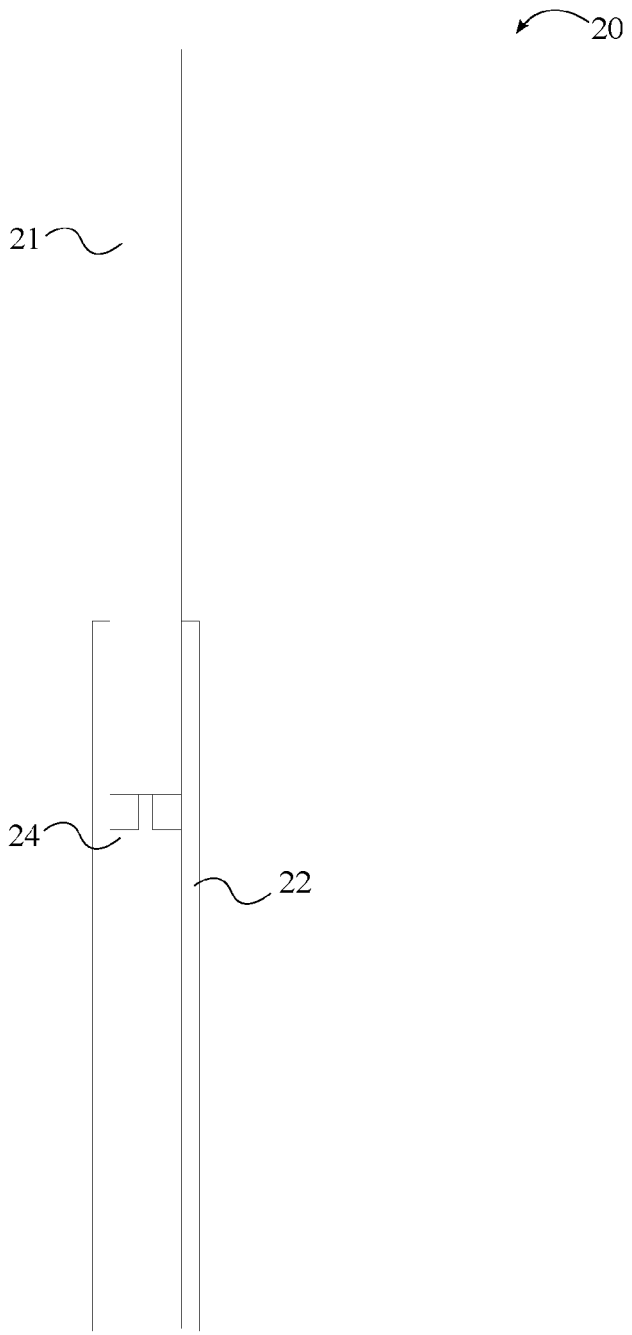
FIG. 9 is a front sectional view of one of the plurality of slide members showing the twist lock mechanism.

In reference to FIG. 9, each of the plurality of slide members 20 may further comprise a twist lock mechanism 24 in order to secure the inner rod 21 in place at a particular depth within the outer rod 22. The twist lock mechanism 24 can be positioned either internally or externally in relation to the inner rod 21 and the outer rod 22. If the twist lock mechanism 24 is positioned internally, then an expander is positioned within either the inner rod 21 or the outer rod 22. When the inner rod 21 and the outer rod 22 are rotated in opposite directions, the expander cams against the inner wall of the opposite rod to which the expander is connected. If the twist lock mechanism 24 is positioned externally, then an annular binder is threaded onto the outer rod 22, such that when the annular binder is tightened, the annular binder clamps the inner rod 21 in place.

It is also possible for alternative locking mechanisms to be used in place of the twist lock mechanism 24 described above. One such alternative locking mechanism is an external lever clamp that is positioned around both the inner rod 21 and the outer rod 22. When the external lever clamp is closed, the inner rod 21 and the outer rod 22 are clamped together. Another alternative locking mechanism is a push-button lock, wherein a spring-loaded button is connected to the inner rod 21 and a plurality of openings are cut along the outer rod 22. The spring-loaded button engages one of the plurality of openings in order to lock the inner rod 21 in place along the outer rod 22, wherein the spring-loaded button can be depressed in order to disengage the opening.

In reference to FIG. 2, the window treatment support 50 is attached to the window rack 10 and allows for the use of window treatments in three dimensions. More specifically, the window treatment support 50 is adjacently attached to the plurality of multi-directional connectors 30. Window treatments, such as curtains and drapes, are attached to the window treatment support 50 and used to create decorative window arrangements. The window treatments can be manufactured in a myriad of styles and patterns including, but not limited to, classic, country, contemporary, Victorian, or retro. The window treatment support 50 can be configured in any number of different shapes, allowing for the creation of unique window arrangements.

Figure 7:
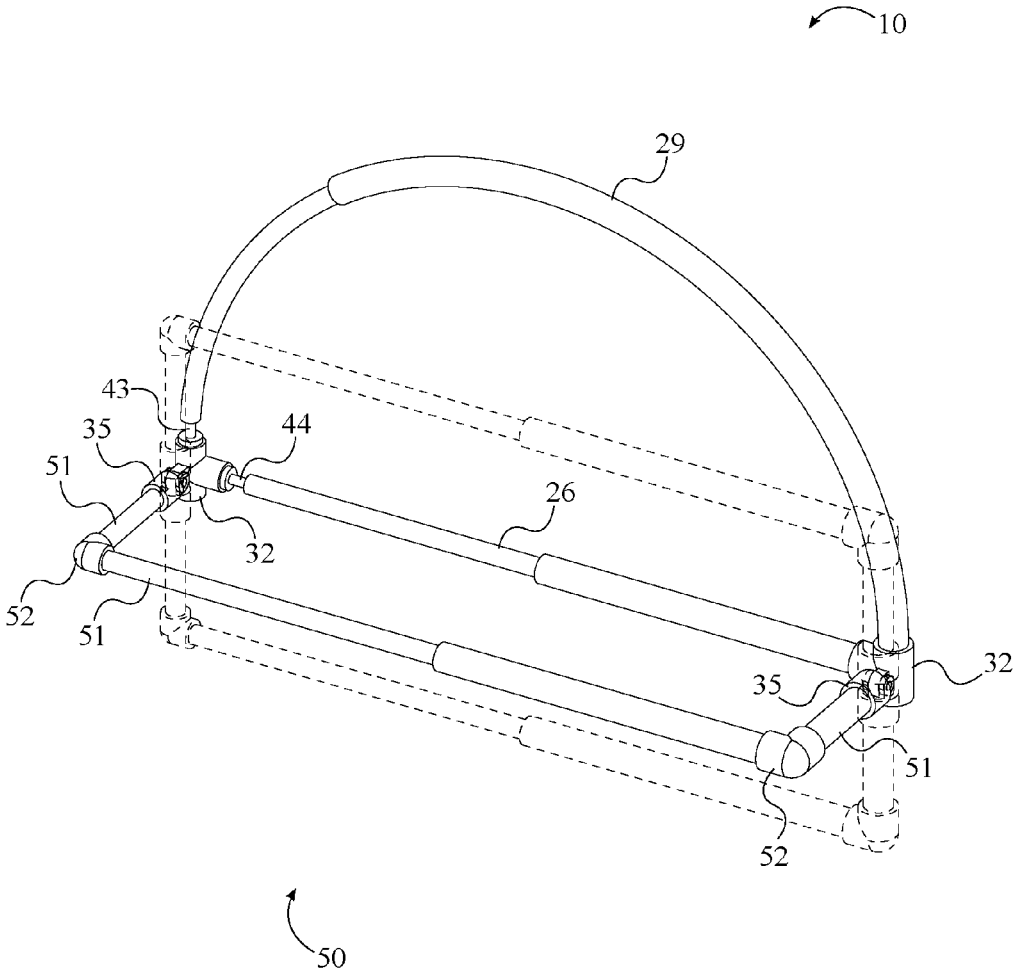
FIG. 7 is a perspective view of the window treatment support, having a plurality of support rods, being attached to the window rack through the hinged connector of each of the pair of multi-directional connectors, wherein the window treatment support can be positioned at a variable angle as depicted by the dotted lines.

In some embodiments of the window treatment support 50, the window treatment support 50 comprises a plurality of support rods 51 and a plurality of bi-directional couplers, as shown in FIG. 7. The plurality of support rods 51 is attached to each other by the plurality of bi-directional connectors 52, wherein the plurality of bi-directional connectors 52 can be designed to provide a variety of angled or curved connections. Each of the plurality of support rods 51 may be straight or curved. Given the variety in the design of the plurality of support rods 51 and the plurality of bi-directional connectors 52, the window treatment support 50 can be configured into a myriad of shapes and designs, such as being wavy, zigzag, rectangular, triangular, etc. The plurality of bi-directional connectors 52 can also be used to attach the window treatment support 50 to the window rack 10 through the plurality of multi-directional connectors 30.

Figure 6:
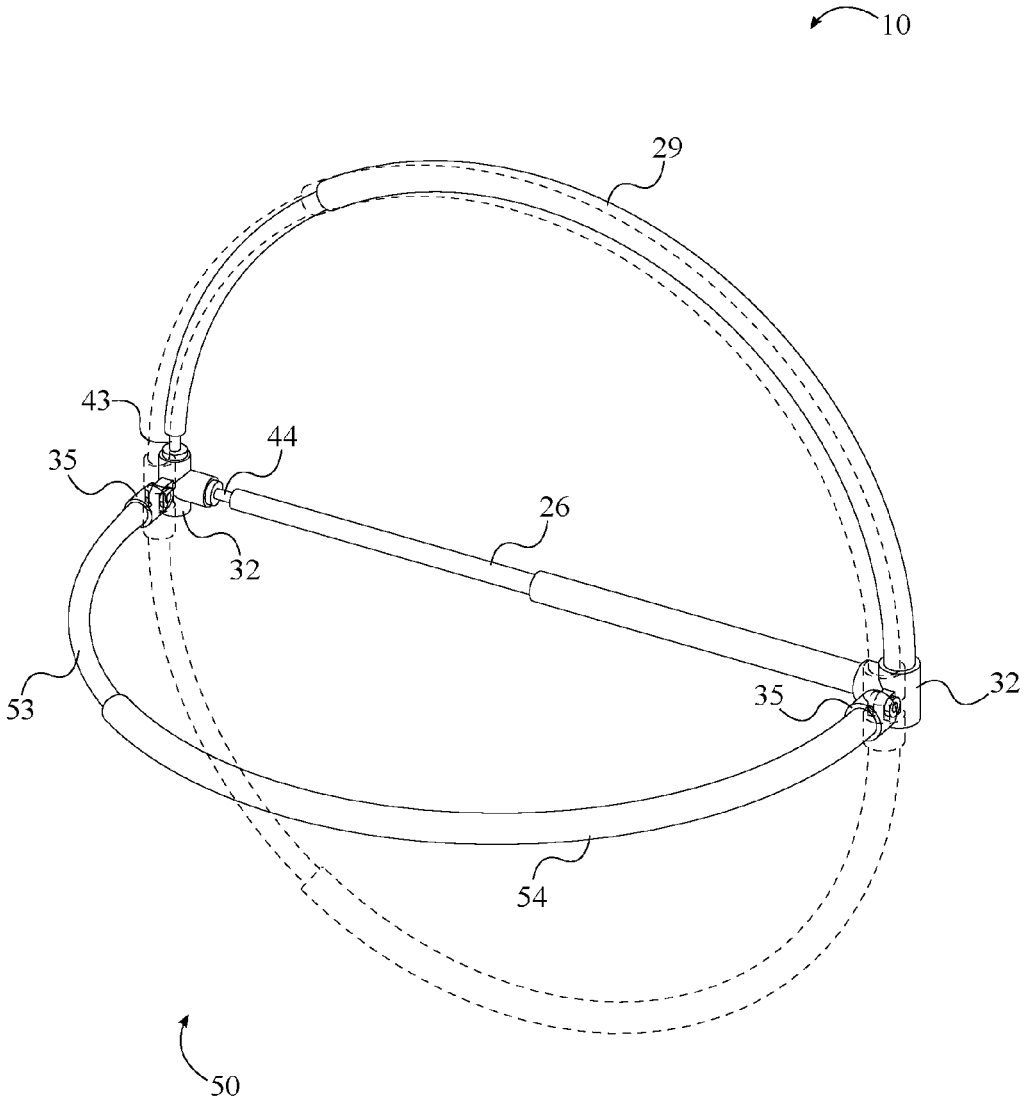
FIG. 6 is a perspective view of the window treatment support, having an inner support rod and an outer support rod, being attached to the window rack through the hinged connector of each of the pair of multi-directional connectors, wherein the window treatment support can be positioned at a variable angle as depicted by the dotted lines.

In reference to FIG. 6, in one embodiment of the window treatment support 50, the window treatment support 50 comprises an inner support rod 53 and an outer support rod 54. The inner support rod 53 is slidably attached to the outer support rod 54, wherein the inner support rod 53 is positioned into the outer support rod 54. Both the inner support rod 53 and the outer support rod 54 are curved in order to create an arch that extends outwards from the window rack 10. The ability for the inner support rod 53 to slide within the outer support rod 54 allows the window treatment support 50 to conform to the size of the window rack 10. The plurality of bi-directional connectors 52 can also be used to attach the inner support rod 53 and the outer support rod 54 to the window rack 10 through the plurality of multi-directional connectors 30. Ideally each of the plurality of bi-directional connectors 52 is a forty five degree street elbow, however, any other connector type can be employed.

In reference to FIG. 1-3, in the preferred embodiment of the present invention, the window rack 10 forms a semi-circular frame, wherein the plurality of slide members 20 comprises a horizontal slide member 26 and a curved slide member 29. Additionally, the plurality of multi-directional connectors 30 is specifically a pair of multi-directional connectors 32. The pair of multi-directional connectors 32 is adjacently attached to the horizontal slide member 26, wherein the horizontal slide member 26 is positioned in between each of the pair of multi-directional connectors 32. The curved slide member 29 is adjacently attached to the pair of multi-directional connectors 32. The at least one spring-loaded coupler 40 is specifically the first spring-loaded coupler 43 and the second spring-loaded coupler 44. The first spring-loaded coupler 43 is attached in between a specific connector 31 from the pair of multi-directional connectors 32 and the curved slide member 29; the curved slide member 29 being the corresponding slide member 25. Meanwhile, the second spring-loaded coupler 44 is attached in between the specific connector 31 and the horizontal slide member 26; the horizontal slide member 26 being the corresponding slide member 25. The window treatment support 50 being curved and having the inner support rod 53 and the outer support rod 54 is attached to the pair of multi-directional connectors 32. The window treatment support 50 is attached to the pair of multi-directional connectors 32 by the plurality of bi-directional connectors 52 each being forty five degree street elbows.

In other embodiments of the present invention, each of the pair of multi-directional connectors 32 comprises a hinged connector 35. The hinged connector 35 of each of the pair of multi-directional connectors 32 allows the window treatment support 50 to be pivoted about the window rack 10. The window treatment support 50 is adjacently connected to the hinged connector 35 of each of the pair of multi-directional connectors 32. In reference to FIG. 6-7, if the window treatment support 50 is adjacently attached to the hinged connector 35 of each of the pair of multi-directional connectors 32, the hinged connector 35 allows the window treatment support 50 to be retracted by folding the window treatment support 50 parallel to the plurality of slide members 20. Additionally, the hinged connector 35 of each of the pair of multi-directional connectors 32 allows the window treatment support 50 to be positioned at a variable angle with respect to the plurality of slide members 20.

In a subsequent embodiment of the present invention, the window rack 10 forms a rectangular frame, wherein the plurality of slide members 20 comprises the horizontal slide member 26, a pair of vertical slide members 27, and a bottom slide member 28. Additionally, the plurality of multi-directional connectors 30 comprises a pair of multi-directional connectors 32 and a pair of bottom multi-directional connectors 33. The pair of multi-directional connectors 32 is adjacently attached to the horizontal slide member 26, wherein the horizontal slide member 26 is positioned in between each of the pair of multi-directional connectors 32. The pair of vertical slide members 27 is adjacently attached to the pair of multi-directional connectors 32 at a ninety degree angle in relation to the horizontal slide member 26. The pair of bottom multi-directional connectors 33 is adjacently attached to the pair of vertical slide members 27 opposite the pair of multi-directional connectors 32. The bottom slide member 28 is adjacently attached to the pair of bottom multi-directional connectors 33, wherein the bottom slide member 28 is positioned in between each of the pair of bottom multi-directional connectors 33. In other words, the horizontal slide member 26 and the bottom slide member 28 are positioned perpendicular to the pair of vertical slide members 27 and positioned opposite each other along the pair of vertical slide members 27.

The plurality of slide members 20 may also include the curved slide member 29 for window frames having an arch. The curved slide member 29 is adjacently attached to the pair of multi-directional connectors 32 opposite the pair of vertical members, wherein the curved slide member 29 is positioned adjacent to the horizontal slide member 26 opposite the pair of vertical slide members 27. The inner rod 21 and the outer rod 22 of the curved slide member 29 allow the arch of the curved slide member 29 to be adjusted in order to fit the size of the window frame. A curved slide member 29 can also be attached to the pair of bottom multi-directional connectors 33 in place of or in addition to the curved slide member 29 attached to the pair of multi-directional connectors 32; wherein the curved slide member 29 attached to the pair of bottom multi-directional connectors 33 is positioned adjacent to the bottom slide member 28 opposite the pair of vertical slide members 27.

Furthermore, in the subsequent embodiment of the present invention, the at least one spring-loaded coupler 40 is specifically the pair of spring-loaded couplers 42. Each of the pair of spring-loaded couplers 42 is attached in between the specific connector 31 from the pair of multi-directional connectors 32 and the corresponding slide member 25 from the plurality of slide members 20. More specifically, each of the pair of spring-loaded couplers 42 is positioned in between the specific connector 31 and the corresponding slide member 25 from the pair of vertical slide members 27, wherein the pair of vertical slide members 27 is attached to the pair of multi-directional connectors 32 by the pair of spring-loaded couplers 42. In this way, the horizontal slide member 26, along with the pair of multi-directional connectors 32, can be depressed in order to fit the window rack 10 into a window frame.

In the subsequent embodiment of the present invention, the window treatment support 50 being curved and having the inner support rod 53 and the outer support rod 54 is attached to the pair of multi-directional connectors 32; wherein the window treatment support 50 is positioned adjacent to the horizontal slide member 26. The window treatment support 50 is attached to the pair of multi-directional connectors 32 by the plurality of bi-directional connectors 52 each being forty five degree street elbows, wherein the window treatment support 50 is positioned perpendicular to the plurality of slide members 20. A window treatment support 50 being curved and having the inner support rod 53 and the outer support rod 54 is also attached to the pair of bottom multi-directional connectors 33; wherein the window treatment support 50 is positioned adjacent to the bottom slide member 28. Again, the window treatment support 50 is attached to the pair of bottom multi-directional connectors 33 by the plurality of bi-directional connectors 52 each being forty five degree street elbows, wherein the window treatment support 50 is positioned perpendicular to the plurality of slide members 20. In this way, window treatments can be secured along the top and bottom of the present invention.

In other embodiments of the present invention, the plurality of multi-directional connectors 30 further comprises a pair of hinged connectors 34. The pair of hinged connectors 34 allows either the curved slide member 29 or the window treatment support 50 to be pivoted about the window rack 10. If the window treatment support 50 is adjacently attached to the pair of hinged connectors 34, the pair of hinged connectors 34 allows the window treatment support 50 to be retracted by folding the window treatment support 50 parallel to the plurality of slide members 20. Additionally, the pair of hinged connectors 34 allows the window treatment support 50 to be positioned at a variable angle with respect to the plurality of slide members 20. If the curved slide member 29 is adjacently attached to the pair of hinged connectors 34, the pair of hinged connectors 34 allows the curved slide member 29 to be positioned into the arch of a window frame or positioned at a variable angle with respect to the plurality of slide members 20; wherein the curved slide member 29 serves as the window treatment support 50. The curved slide member 29 can be attached to the pair of hinged connectors 34 adjacent to the horizontal slide member 26 or attached to the pair of hinged connectors 34 adjacent to the bottom slide member 28.

It is also possible in other embodiments of the present invention for the plurality of multi-directional connectors 30 to comprise a single hinged connector or a plurality of hinged connectors. Additionally, the single hinged connector, the pair of hinged connectors 34, or the plurality of hinged connectors can be used to connect any of the plurality of slide members 20 to each other.

It is also possible for the plurality of slide members 20 and the plurality of multi-directional connectors 30 to be arranged in any number of other ways in addition to the embodiments described above. Such other embodiments could feature configurations for circular windows, octagonal windows, or windows of any other geometric shape.

Once the window rack 10 has been formed from the plurality of slide members 20, the plurality of multi-directional connectors 30, and the at least one spring-loaded coupler 40, the window rack 10 can be installed into a window frame. In order to install the window rack 10, each of the plurality of slide members 20 is adjusted to the desired length. The at least one spring-loaded coupler 40 is then compressed such that the outer perimeter of the window rack 10 is smaller than the inner perimeter of the window frame. The window rack 10 is then inserted into the window frame and the at least one spring-loaded coupler 40 is released, allowing the window rack 10 to snuggly press against the window frame. The window rack 10 is just as easily removed, by compressing the at least one spring-loaded coupler 40 and sliding the window rack 10 out from the window frame.

Figure 4:
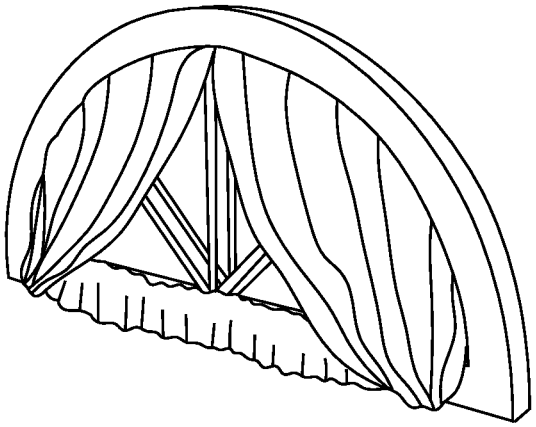
FIG. 4 is a perspective view of the window rack positioned within in a window frame having attached window treatments.
Figure 5:
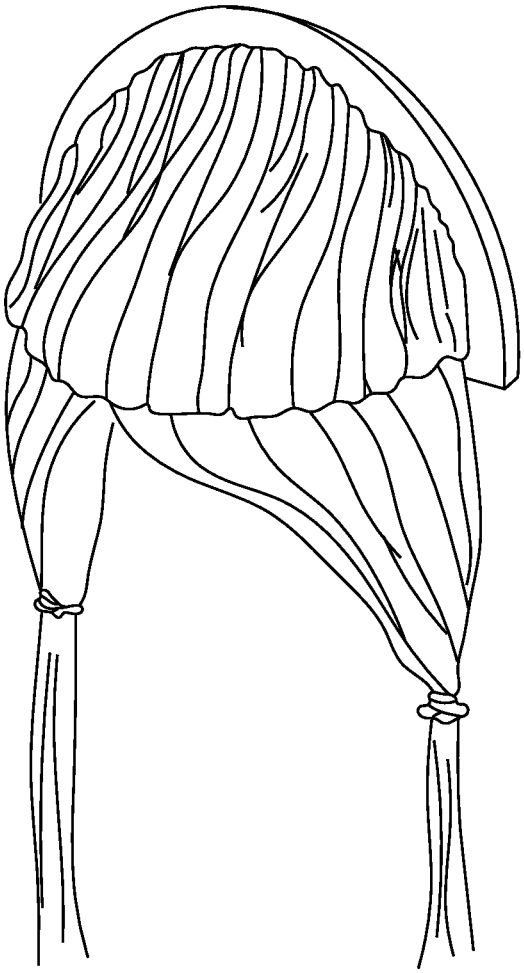
FIG. 5 is a perspective view of the window rack positioned within a window frame having an attached window treatment support and window treatments.

Once the window rack 10 has been installed, the window treatment support 50 can then be attached to the window rack 10. The window rack 10 support is first slid through, or otherwise attached to, the desired window treatments. Once the window treatments are secured to the window treatment support 50, the window treatment support 50 can then be attached to the window rack 10 through the plurality of multi-directional connectors 30. Window treatments can be hung using only the window rack, as shown in FIG. 4, or using both the window rack and the window treatment support, as shown in FIG. 5. A plug 70 can be positioned into the unused openings of each of the plurality of multi-directional connectors 30, as shown in FIG. 1.

In addition to providing three dimensional window treatment arrangements that are projected out and away from a window frame, the present invention can be used in bay windows and deep well window casings. In such an instance, the window treatment support 50 is attached to the window rack 10 prior to installing the window rack 10 within the window frame. Once attached to the window rack 10, the window treatment support 50 is directed in towards the bay window or deep well window casing and the window rack 10 is installed in the same manner as described above by utilizing the at least one spring-loaded coupler 40. It is also possible for a window treatment support 50 to be attached to the opposite side of the window rack 10 as well, such that a window treatment support 50 is directed away from the window frame in addition to the window treatment support 50 positioned within the bay window or deep well window casing.

Although the invention has been explained in relation to its preferred embodiment, it is to be understood that many other possible modifications and variations can be made without departing from the spirit and scope of the invention as hereinafter claimed.

What is claimed is:

1. A spring-loaded adjustable window rack comprises:
- a plurality of slide members;
- a pair of multi-directional connectors;
- a first spring-loaded coupler;
- a second spring-loaded coupler;
- the plurality of slide members comprises a horizontal slide member and a curved slide member;
- the pair of multi-directional connectors being adjacently attached to the horizontal slide member;
- the horizontal slide member being positioned in between each of the pair of multi-directional connectors;
- the curved slide member being adjacently attached to the pair of multi-directional connectors;
- each of the plurality of slide members comprises an inner rod and an outer rod;
- the inner rod being slidably attached to the outer rod;
- the inner rod being positioned into the outer rod;
- the first spring-loaded coupler being attached in between a specific connector from the pair of multi-directional connectors and the curved slide member;
- the second spring-loaded coupler being attached in between the specific connector from the pair of multi-directional connectors and the horizontal slide member;
- a window treatment support;
- the window treatment support being adjacently attached to the pair of multi-directional connectors;
- the window treatment support comprises a plurality of support rods and a plurality of bi-directional connectors; and
- the plurality of support rods being attached to each other by the plurality of bi-directional connectors.

2. The spring-loaded adjustable window rack as claimed in claim 1 comprises:
- each of the pair of multi-directional connectors comprises a hinged connector; and
- the window treatment support being adjacently attached to the hinged connector of each of the pair of multi-directional connectors.

3. A spring-loaded adjustable window rack comprises:
- a plurality of slide members;
- a pair of multi-directional connectors;
- a first spring-loaded coupler;
- a second spring-loaded coupler;
- the plurality of slide members comprises a horizontal slide member and a curved slide member;
- the pair of multi-directional connectors being adjacently attached to the horizontal slide member;
- the horizontal slide member being positioned in between each of the pair of multi-directional connectors;
- the curved slide member being adjacently attached to the pair of multi-directional connectors;
- each of the plurality of slide members comprises an inner rod and an outer rod;
- the inner rod being slidably attached to the outer rod;
- the inner rod being positioned into the outer rod;
- the first spring-loaded coupler being attached in between a specific connector from the pair of multi-directional connectors and the curved slide member;
- the second spring-loaded coupler being attached in between the specific connector from the pair of multi-directional connectors and the horizontal slide member;
- a window treatment support;
- the window treatment support being adjacently attached to the pair of multi-directional connectors;
- the window treatment support comprises an inner support rod and an outer support rod;
- the inner support rod being slidably attached to the outer support rod; and the inner support rod being positioned into the outer support rod.

4. The spring-loaded adjustable window rack as claimed in claim 3 comprises:

each of the pair of multi-directional connectors comprises a hinged connector; and the window treatment support being adjacently attached to the hinged connector of each of the pair of multi-directional connectors.

* * * * *